US006796712B1

(12) United States Patent
Achhammer

(10) Patent No.: US 6,796,712 B1
(45) Date of Patent: Sep. 28, 2004

(54) BUTT-ENDED BAG WITH A BUCKLE-OVER CLOSING ELEMENT

(75) Inventor: Hermann Achhammer, Rougemont le Chateau (FR)

(73) Assignee: SPS Verpackungs-System GmbH, Munich (DE)

( * ) Notice: Subject to any disclaimer, the term of this patent is extended or adjusted under 35 U.S.C. 154(b) by 0 days.

(21) Appl. No.: 10/148,397

(22) PCT Filed: Oct. 20, 2000

(86) PCT No.: PCT/EP00/10357

§ 371 (c)(1),
(2), (4) Date: Nov. 7, 2002

(87) PCT Pub. No.: WO01/40074

PCT Pub. Date: Jun. 7, 2001

(30) Foreign Application Priority Data

Nov. 30, 1999 (DE) ..... 199 57 563

(51) Int. Cl.[7] ..... B65D 33/16

(52) U.S. Cl. ..... 383/80; 383/104; 383/120; 383/906; 222/527

(58) Field of Search ..... 383/120, 104, 383/906, 80, 88, 89; 222/527, 528, 531, 537

(56) References Cited

U.S. PATENT DOCUMENTS 2,361,876 A * 10/1944 Schell ..... 222/107
2,950,029 A * 8/1960 Winstead ..... 222/143
3,367,380 A * 2/1968 Dickey ..... 383/104
4,505,312 A * 3/1985 Lardner et al. ..... 141/326
4,572,412 A * 2/1986 Brach et al. ..... 222/527
4,572,413 A * 2/1986 Vogt ..... 222/528
5,065,914 A * 11/1991 Chollet ..... 222/529
5,257,865 A 11/1993 Tani

FOREIGN PATENT DOCUMENTS

DE 94 09 316 8/1994

* cited by examiner

*Primary Examiner*—Jes F. Pascua
(74) *Attorney, Agent, or Firm*—Oblon, Spivak, McClelland, Maier & Neustadt, P.C.

(57) ABSTRACT

A stand up bag of a heat-sealable or weldable plastic film for receiving liquid and/or paste-like material. The bag includes two side walls connected to each other along their longitudinal edges. A foldable bottom member is positioned between the side walls and serves as a self-standing bottom inserted at the lower end of the stand up bag between lower transverse edges. A foldable cover member is positioned at the upper end of the stand up bag between the side walls and includes a removal opening between the upper transverse edge of a first side wall and the corresponding cover member edge, with a closure element inserted into the removal opening. To be able to empty the stand up bag in a better and simpler way, the closure element is bendable and is retained by a mechanism for stabilizing and retaining the forwardly bent closure element.

13 Claims, 7 Drawing Sheets

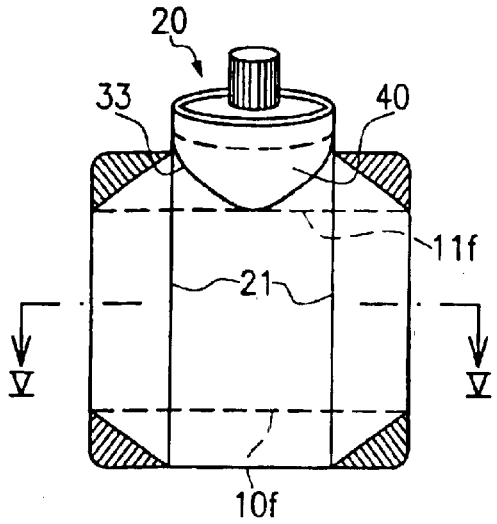
FIG.2
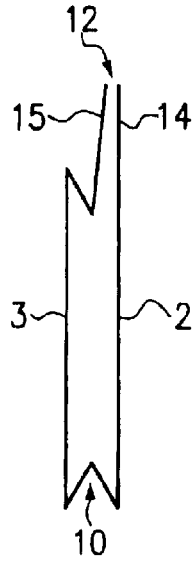
FIG.3
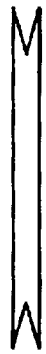
FIG.4
FIG.5
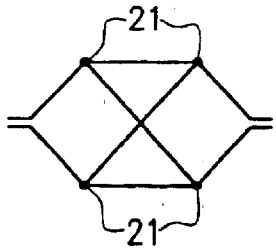
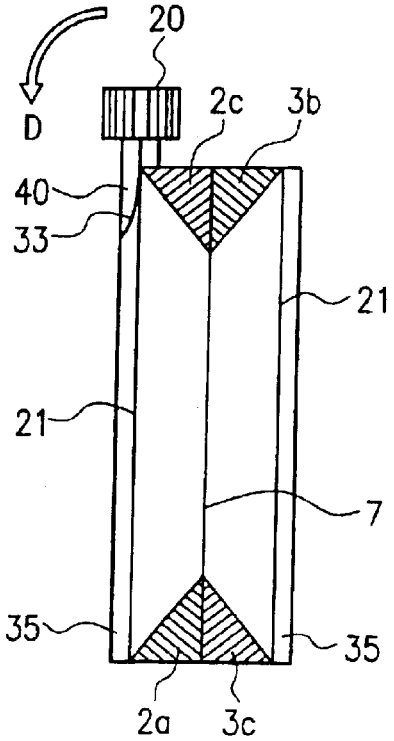
FIG.6
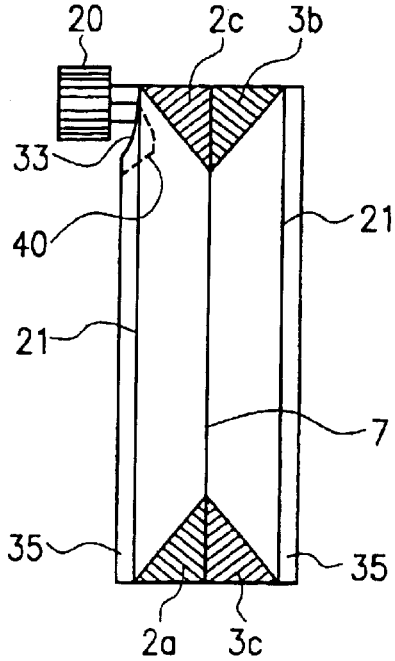
FIG.7

BUTT-ENDED BAG WITH A BUCKLE-OVER CLOSING ELEMENT

The present invention relates to a stand up bag consisting of a heat-sealable or weldable plastic film for receiving liquid and/or paste-like material, the bag comprising two side walls connected to each other at their longitudinal edges, a foldable bottom member which is positioned between the side walls and serves as a self-standing bottom being arranged at the lower end of the stand up bag between the lower transverse edges, and a foldable cover member being positioned at the upper end of the stand up bag between the side walls, and comprising a removal opening between the upper transverse edge of a first side wall and the associated cover member edge, a closure element being inserted into the removal opening.

Such a bag is already known from WO 95/33663. The already known stand up bag, which is shown in FIG. 14, comprises two side walls, a bottom member serving as a self-standing bottom, as well as a cover member. The bottom and cover members come to rest within the contour of the side walls in the connected state of the bag. Said members unfold accordingly while the container is being filled. The members shown in FIG. 14 are welded to one another for forming the bag. In this process the longitudinal edges of the side walls are sealed along the areas shown in broken line. The corner portions of the side walls are connected to portions of the corresponding bottom and cover members in planar or linear fashion in the manner of a triangle. The transverse edges of the side walls shown in broken line are also connected to the corresponding transverse edges of the cover and bottom members. A removal opening is formed between a side wall and the corresponding cover member. A closure element is inserted into said removal opening. However, due to the closure element projecting upwards in a more or less rigid manner, it may sometimes turn out to be difficult to pour the filling material out of the stand up bag because the whole bag must be inclined downwards to a considerable degree. Liquid may get spilled in particular in the case of very full stand up bags.

It is therefore the object of the present invention to improve the known stand up bag with respect to handling, in particular when liquid is poured out.

According to the invention this object is achieved in that the stand up bag is provided in the first side wall in an area below the closure element with means for stabilizing and retaining the closure element in a forwardly bent position.

With the stand up bag according to the invention it is possible to fold the closure element forwards, the element fixedly remaining in said position. The bent closure element will also remain in said position if the stand up bag is gripped by one hand for pouring liquid and is thereby compressed. In the bent position liquid can be poured out safely and simply through the closure element also in the case of very full bags without the need for inclining the bag to a very great degree.

According to a preferred embodiment of the invention the upper cover member is also provided in an area below the closure element with means for stabilizing and retaining the closure element in an upright position.

The stabilizing and retaining means simply consist of at least one linear embossment which e.g. extends from two sides towards the central longitudinal axis of the first side wall. The embossment may extend e.g. in semioval or also triangular fashion. Such embossments form a bending border within which, when the closure element is bent forwards, the area between the embossments and the closure element bulges inwards into the bag.

The embossment is advantageously arranged in the upper third of the first side wall. This leads to the desired stabilization.

According to a preferred embodiment the cover member is connected to the respective side wall via seal seams which extend from both longitudinal edges obliquely towards the removal opening of the first side wall or obliquely towards the upper transverse edge of the second side wall, the sloped seal seams being the outer seams at the same time. Since in this embodiment the sloped seal seams extend from both ends of the longitudinal edges to the removal opening or the upper transverse edge, the cover member is no longer restricted by the longitudinal seam and can easily fold outwards when the bag is being filled. Thanks to the inclined extension of the outer seams, a V-shaped section is formed between the two side walls, said section promoting the unfolding of the cover member and permitting an easier handling of the bag.

According to a preferred embodiment of the present invention the removal opening is formed between a side wall tab formed on a side wall and projecting beyond the transverse edge of the side wall, and a matching cover member tab which is formed on the cover member, the tabs being interconnected along their longitudinal edges. In this embodiment the removal opening is defined by two tabs into which the closure element is inserted. Such an arrangement permits an even better bending of the closure element.

It is advantageous when the side walls are provided with longitudinal embossments which extend in spaced-apart relationship between the transverse edges and are oriented outwards. Said longitudinal embossments form longitudinal fold lines which are embossed in the form of recesses into the film material. In the filled state of the bag this yields a polygonal shape (viewed in horizontal section) of the filled container, depending on the number of the longitudinal embossments, i.e. a design different from the round shape. When two longitudinal embossments of such a type are e.g. arranged in spaced-apart relationship in each side wall, the stand up bag obtained in the end has the shape of a hexagon in the filled state, so that the containers can be stored closely side by side during transportation or also presentation in shelves of shopping centers, resulting in less clearance as would be the case with round cross-sections.

According to a further preferred embodiment the length of the first side wall is greater than the length of the second side wall, so that the removal opening of the first side wall comes to rest above the upper transverse edge of the second side wall. Thanks to such a construction the removal opening projects beyond the bag edge, so that the closure elements, such as a screw type closure, can be welded into the removal opening in a simplified way.

It is advantageous when the cover member is integrally formed with the second side wall. Since the cover member need not be specifically welded to the upper edge of the side wall, this shape makes a welding step superfluous. Moreover, the cover member can bulge in this area in a rounder and smoother form because no projecting weld seam is in the way. This is of particular advantage whenever the closure element is bent forwards, the whole cover member stretching forwards in this process.

The present invention will be described in more detail in the following with reference to the accompanying figures, of which:

FIG. 2 is a front view of the stand up bag of the invention from FIG. 1;

FIG. 3 is a view onto the stand up bag cut longitudinally along line III—III of FIG. 1;

FIG. 4 is a side view onto the stand up bag cut longitudinally along line IV—IV of FIG. 1;

FIG. 5 is a top view onto a container cut horizontally along line V—V in the shape as assumed by it in the filled state;

FIG. 6 is a schematic side view of the filled bag shown in FIG. 2, with an upright closure element;

FIG. 7 shows the filled stand-up bag illustrated in FIG. 6, with bent closure element;

Figure 9:
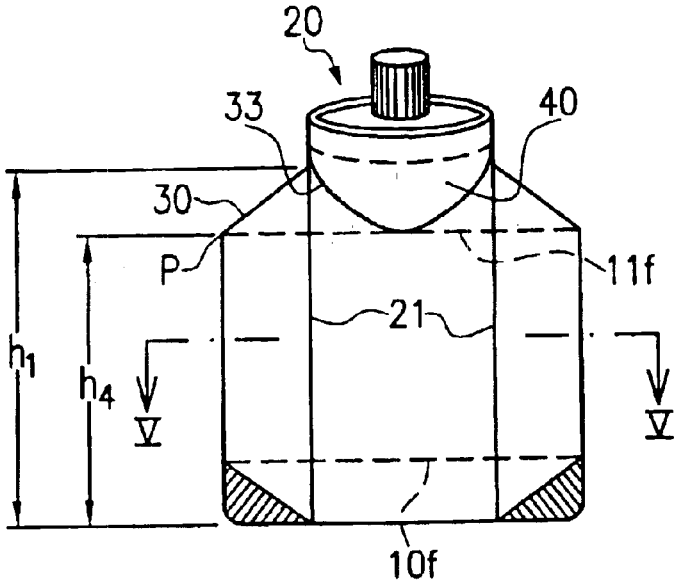
FIG. 9 is the front view of the stand up bag shown in FIG. 8.
Figure 10A:
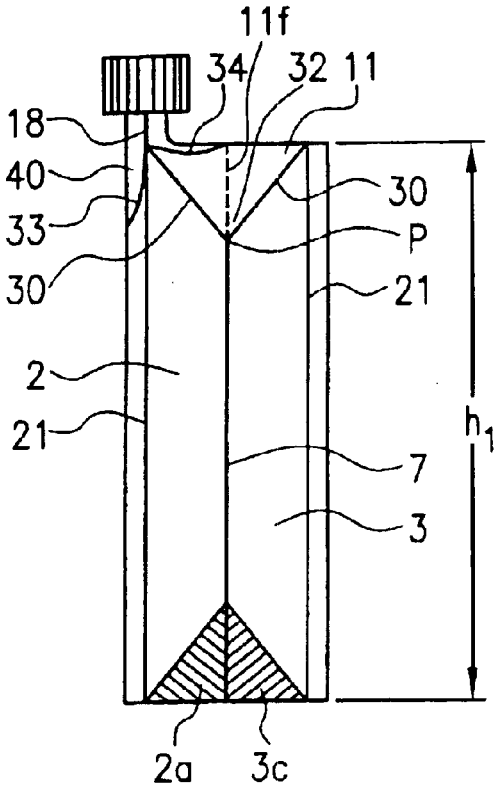
Figure 11A:
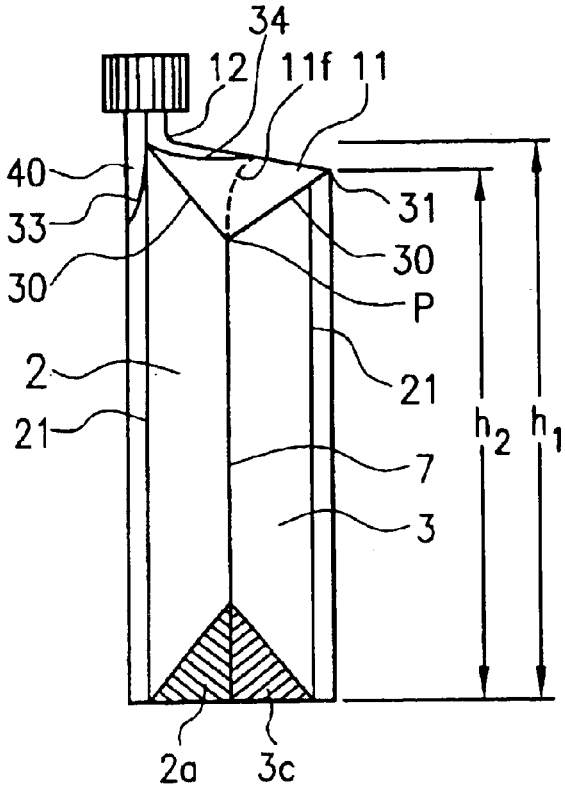
Figure 10B:
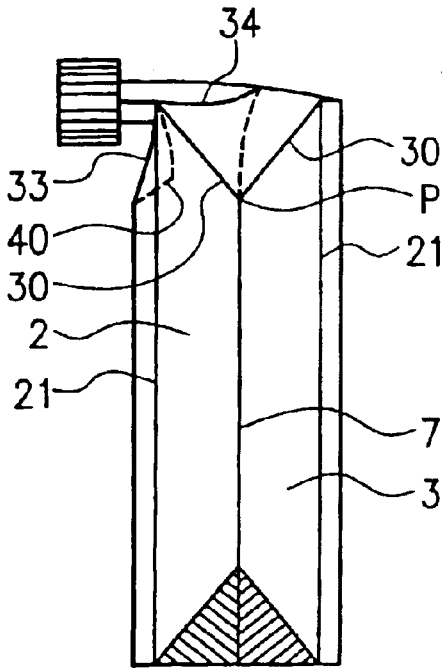
Figure 11B:
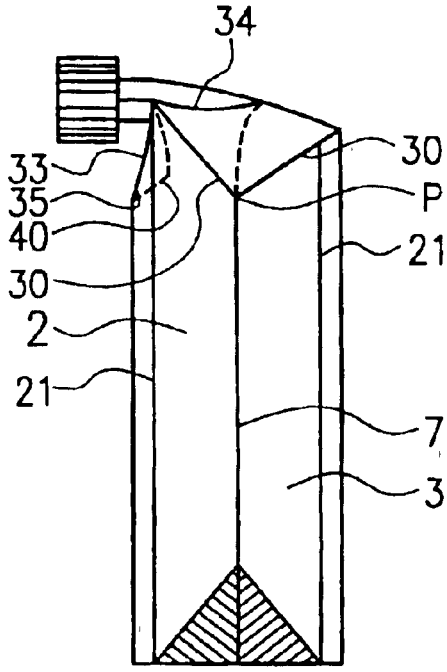
Figure 12:
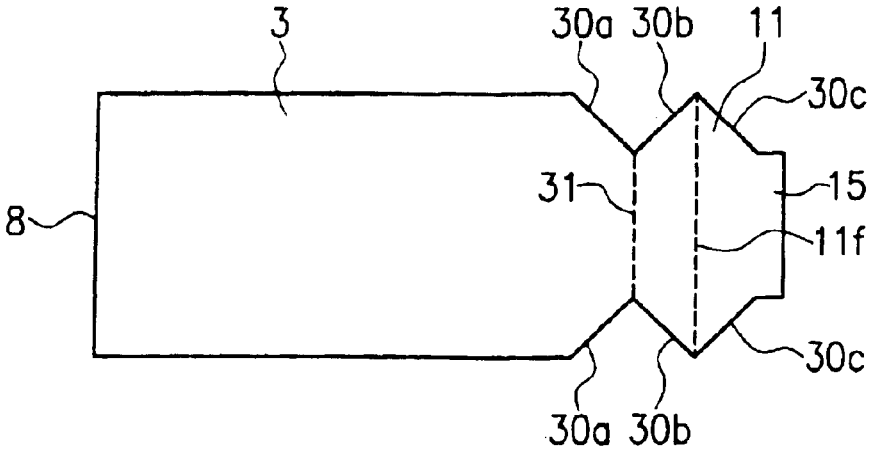
Figure 14:
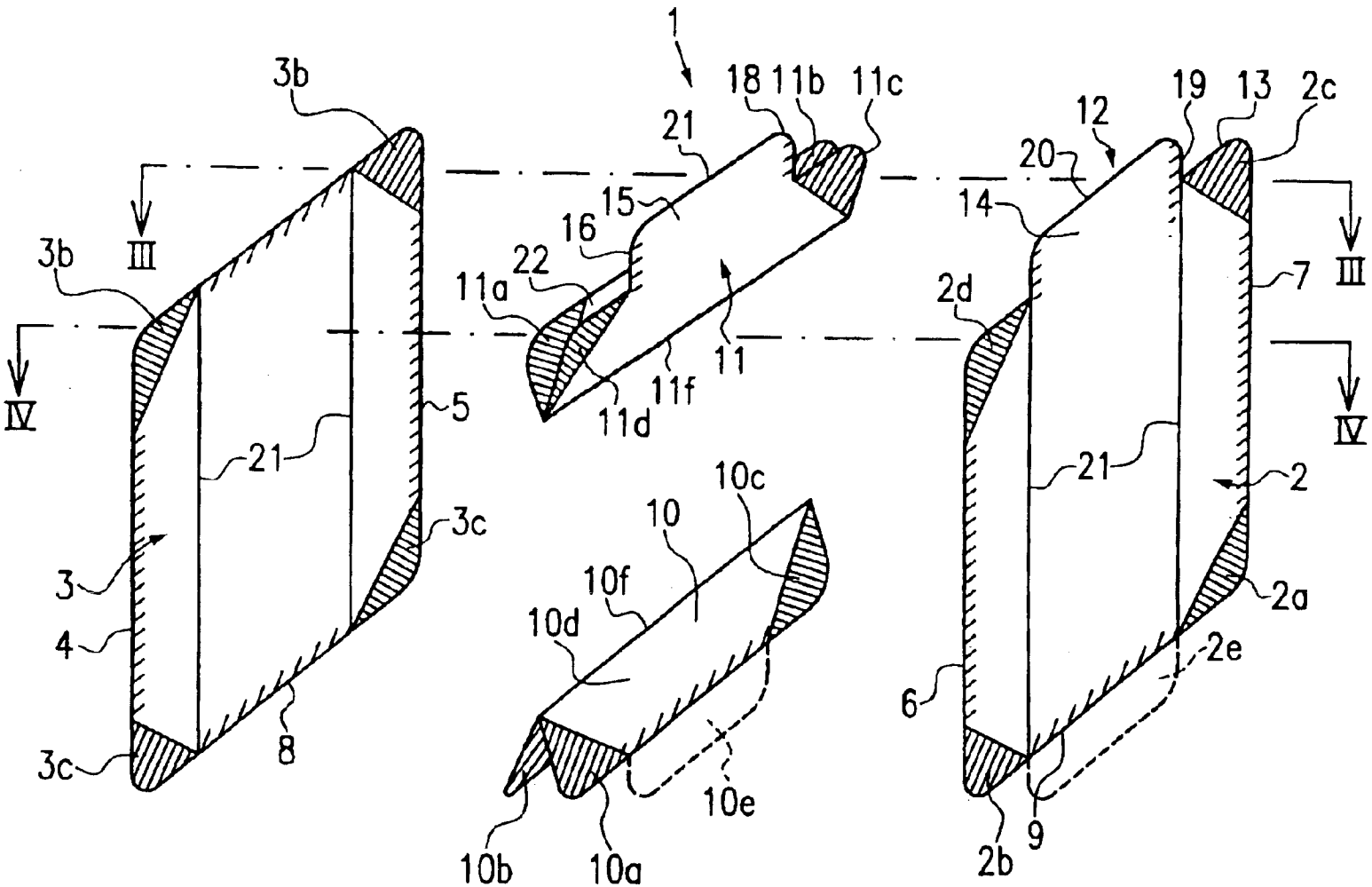

FIG. 10*a* is a schematic side view of the filled bag shown in FIG. 9;

FIG. 10*b* shows the stand up bag illustrated in FIG. 10*a*, with bent closure element;

FIG. 11*a* is a schematic side view of a filled stand-up bag, according to a further embodiment of the present invention;

FIG. 11*b* shows the stand up bag illustrated in FIG. 11*a*, with bent closure element;

FIG. 12 shows a second stand-up-bag side wall made integral with the cover member;

FIGS. 13*a–e* show various embodiments of the means for stabilizing and retaining the bent closure element;

FIG. 14 shows a stand up bag known from the prior art.

Figure 1:
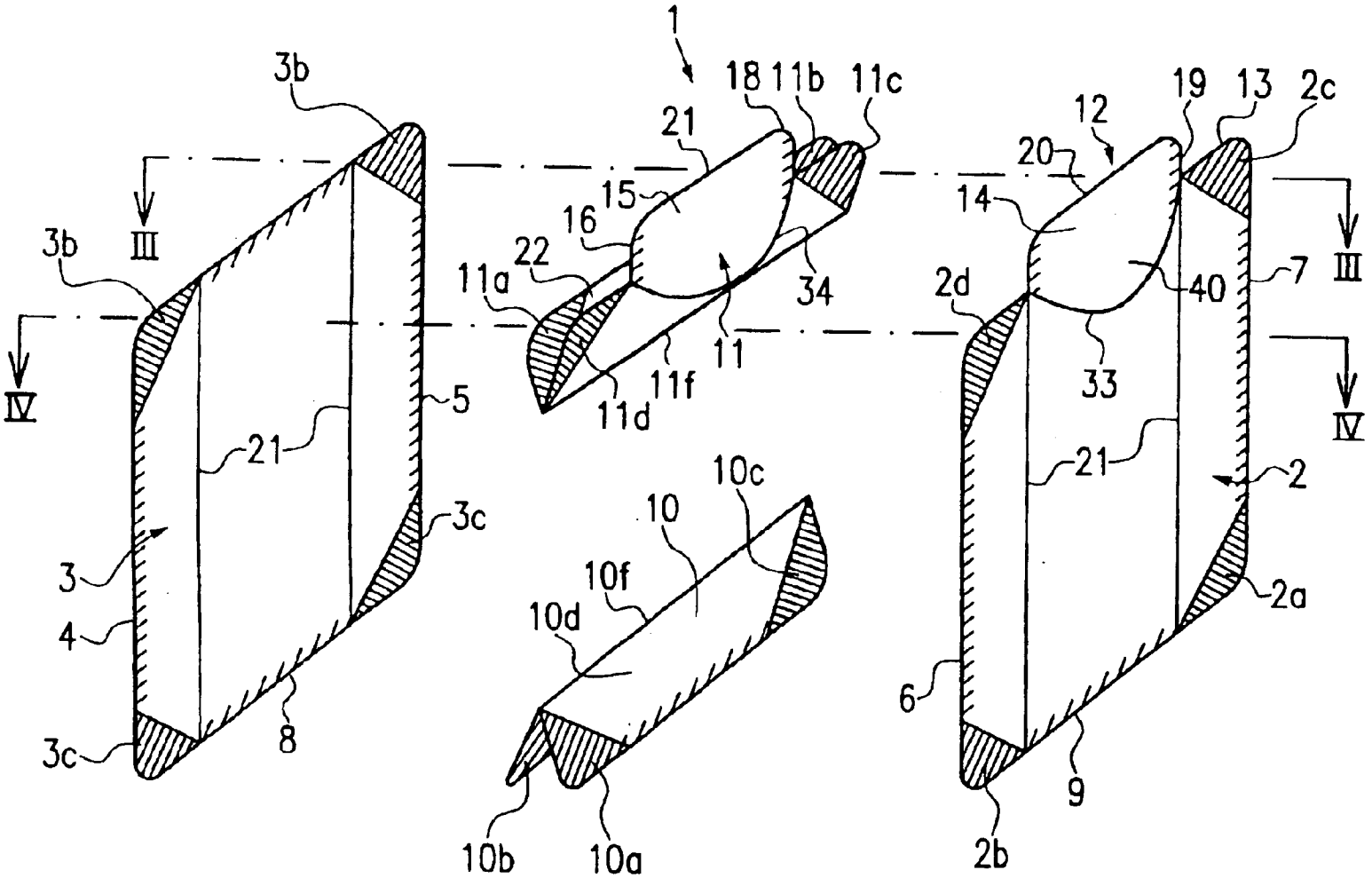
FIG. 1 shows the components of a stand up bag according to the invention in a perspective exploded view, according to a first embodiment.

FIG. 1 shows the individual components of the stand up bag of the invention, according to a first embodiment. These parts are preferably made from double-laminated film material in a manner which is known per se.

The stand up bag according to the invention comprises a side wall 2, a side wall 3, a bottom member 10 serving as a self-standing bottom, as well as a cover member 11.

In the joined state of the bag the bottom and cover members come to rest within the contour of the side walls. These members will unfold accordingly when the container is filled.

A cover member tab 15 is integrally formed with the side wall on the cover member 11. The side wall tab 14 is also integrally formed with the side wall 2, matching the cover member tab 15. The individual members are now connected to one another to form the bag. In this process the longitudinal edges 4 and 5 of the side wall 3 are sealed to the longitudinal edges 6 and 7 of the side wall 2 along the portions shown in broken line. The corner portions 3*a*, 3*b*, 3*c* and 3*d* of the side wall 3 are connected to the corner portions 11*a*, 11*b*, 10*b* and the rear corner of the bottom member, which is not shown in the drawing, in planar fashion in the manner of a triangle.

The corner portions 11*d*, 11*c*, 10*a* and 10*c* are welded in this sequence to the corner portions 2*d*, 2*c*, 2*b* and 2*a* of the side wall 2—also in a triangular manner.

The edges of bottom member and cover member that are each oriented sideways are also longitudinally welded to the longitudinal edges 4 and 6 and 5 and 7, respectively.

Finally, the lower edge 8 is connected to the edge of the bottom member that is assigned to said lower edge 8, while the lower edge of the bottom member 10 which is oriented towards the side wall 2 is welded to the lower edge 9 of said side wall.

The cover member is welded over the length of its upper edge facing the side wall 3, to the corresponding upper edge of the side wall. By contrast, the cover member tab 15 is only welded along its longitudinal edge 16 and 18 to the corresponding longitudinal edges 17 and 19 of the side wall tab 14. The removal opening 12 into which, as shown in FIG. 2, a closure element, here: a screw type closure element, is welded is created by the welding or sealing operation along the longitudinal edges of the cover member tab and the side wall tab. The bag obtained thereby can then be closed again easily if it has not been emptied entirely after use.

Moreover, the side walls 2 and 3 are provided with outwardly oriented longitudinal embossments 21 extending in spaced-apart relationship with each other, as can also be seen in FIG. 5.

Said longitudinal embossments 21, of which two are implemented each side wall in the illustrated embodiment, have the effect that in the top view cut along line V—V of FIG. 2 the filled bag assumes a shape as shown in FIG. 5. With such a hexagonal shape the bags can easily be arranged side by side without any clearance. FIGS. 3 and 4 show the corresponding longitudinal sectional shapes of the stand up bag.

As follows clearly from FIGS. 1 and 2, the stand up bag according to the invention also comprises a means 33 for stabilizing and retaining the forwardly bent closure element 20. The means for stabilizing and retaining is here formed by the line embossment 33 which extends into an area below the inserted closure element 20. In this embodiment, the embossment 33 is oriented from the inside to the outside approximately in semioval fashion. An area 40 which, as will still be explained further below, bulges inwards upon bending of the closure portion is created between the embossment 33 and the closure element 30.

FIGS. 6 and 7 are a side view showing the stand up bag illustrated in FIG. 2, the bag being in its filled state. Since the bag is filled, it bulges outwards, as illustrated by portions 35. FIG. 6 shows the closure element 20 in an upright position. Moreover, FIG. 6 clearly shows the embossment 33 and the area 40 between embossment 33 and closure element 20. When for an improved pouring of liquid the closure element 20 is now bent downwards in the direction of arrow D, e.g. by 90°, as shown in FIG. 7, area 40 can turn inwards into the bag, as illustrated by the broken line. The curvature within embossment 33 stabilizes and retains the bent closure element in its position. Even if the flexible bag is firmly enclosed by one hand and compressed, the pressure produced thereby is not sufficient for bringing the closure element 20 back into its upright position because said pressure equally acts on the cover member which stretches due to the bending operation—in particular in cases where according to a preferred embodiment the cover member can also be provided with an embossment 34, as shown in FIG. 1. Said embossment 34 extends in the joined welded state below the inserted closure element 20 and extends in this instance also in semioval fashion to the fold edge 11*f* of the cover member 11. The embossment 34 is also directed from the inside to the outside. On the one hand, it serves to stabilize the cover member when the closure element is in an upright position; on the other hand, the portion which bulges outwards within the embossment in the bent state of the closure stabilizes the closure also in this bent position. In said first embodiment the embossment 33 extends between the longitudinal embossments 21, and embossment 33 additionally extends approximately in the upper third of the first side wall 2.

Figure 8:
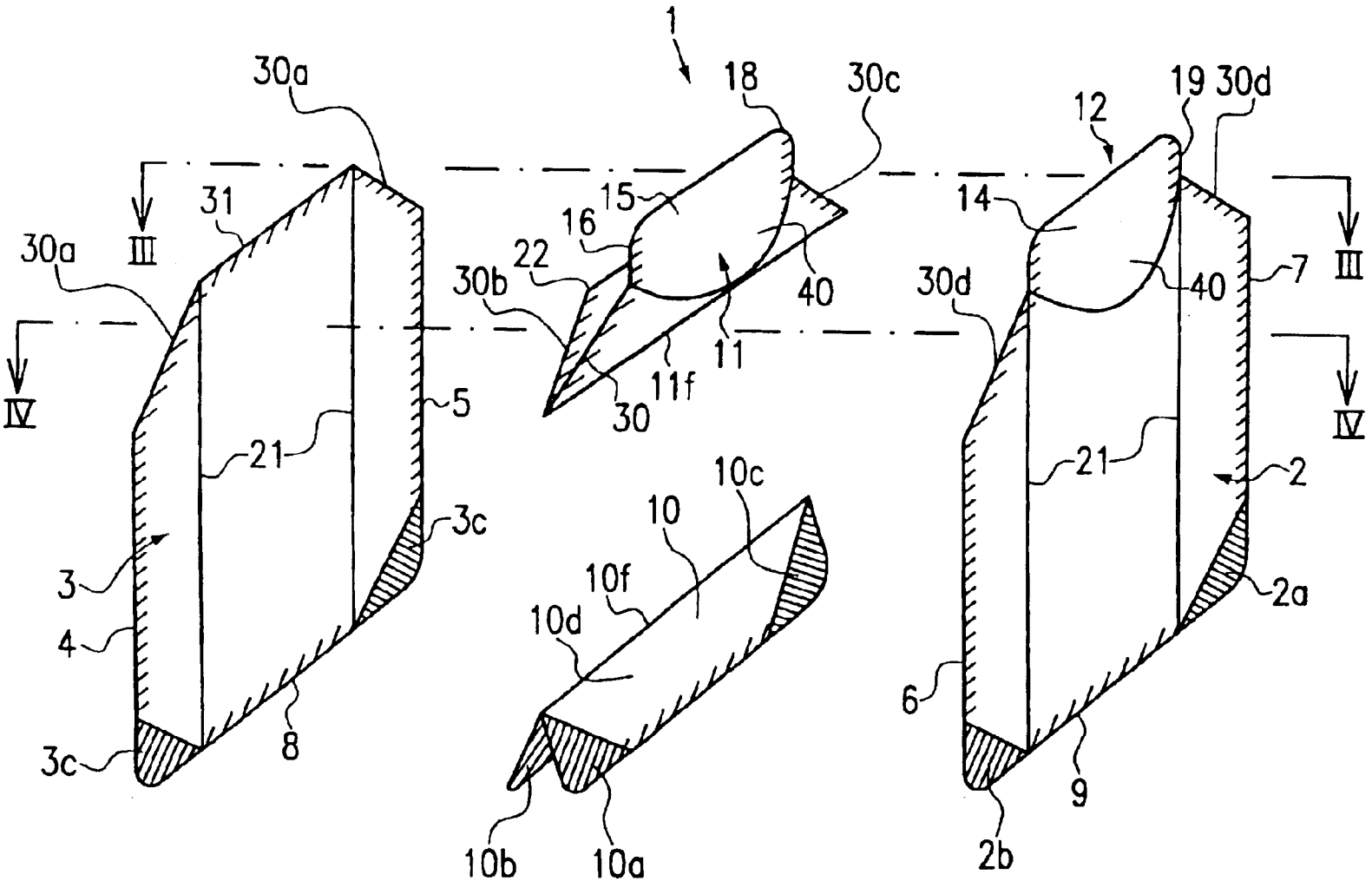
FIG. 8 shows the components of a stand up bag according to the invention in a perspective exploded view, according to a second embodiment.

FIG. 8 shows a further embodiment of the stand up bag according to the invention. Said bag differs from the bag shown in FIG. 1 in that the cover member is connected to the respective side wall 3, 2 via seal seams 30 which extend from both ends of the longitudinal edges 4, 7 obliquely to the removal opening 12 of the first side wall 2 and obliquely relative to the transverse edge 31 of the second side wall 3. The oblique edges 30*a* of the side wall 3 are here sealed to the oblique edges of the cover member 30*b*, and the oblique edges 30*d* of the first side wall 2 are sealed to the oblique edges 30*c* of the cover member. The upper transverse edge 22 is welded to the upper transverse edge 31 of the side wall. By contrast, the cover member tab 15 is only welded along its longitudinal edges 16, 18 to the corresponding longitudinal edges 17 and 19 of the side wall tab 14. The removal opening 12 into which, as shown in FIG. 2, a closure element 20, e.g. a screw type closure element, is welded is created by welding or sealing along the longitudinal edges, the cover member tab and the side wall tab.

As becomes apparent from FIG. 9, the longitudinal edges 4, 7 extend only up to a point P which is positioned at the same level as the central fold edge 11*f* of the cover member 11. Two seal seams 30 respectively extend from said point P at both sides of the stand up bag up to the removal opening 12 or the upper transverse edge 31 of the respective side walls 2, 3. Since the longitudinal seams 4, 7 do not extend over the whole length hi up to the removal opening 12, the seal seams 30 which represent the outer seams can freely move apart in the case of a filled bag, as is e.g. shown in FIG. 10*a*, and can thus form a V-shaped section 32. Hence, the cover member can easily be folded apart, and an easy handling of the bag is ensured in addition.

In this embodiment, a means 33 is also provided for stabilizing and retaining the forwardly bent closure element. Like in the first embodiment, the embossment 33 extends in an area below the closure element in semioval fashion. The embossment is directed from the inside to the outside. Area 40 is created between the closure element 20 and embossment 33, as becomes clearly apparent from FIGS. 9 and 10*a*. As follows from the filled bag shown in FIG. 10*a*, the bag according to the invention may comprise a cover member 11 which also comprises an embossment 34 which extends from the closure element 20 towards the central fold edge 11*f* of the cover member 11. When the closure element is e.g. bent forwards by 90°, the area 40 between embossment 33 and closure element 20 turns inwards, as follows from FIG. 10*b*. The bent closure element 20 is stabilized and retained in said position by embossment 33 even if the bag is held for pouring out the liquid and thus compressed. When the closure element 20 is bent forwards, the cover member 11 is stretched.

The bag shown in FIGS. 11*a* and 11*b* is substantially identical with the bag shown in FIGS. 10 and 10*b*, except for the difference that length h1 of the first side wall 2 is greater than length h2 of the second side wall 3, so that the removal opening 12 of the first side wall comes to rest above the upper transverse edge 31 of the second side wall 3.

The bag shown in FIGS. 8–11 may also be formed without embossments or stabilizing means 33, 34 on the first side wall and the cover member.

As shown in FIG. 12, the cover member 11 which is inserted between the side walls 2 and 3 need not be welded to the upper edge 21 of the side wall 3, but can integrally be formed with the side wall 3. Since the cover member need not specifically be welded to the upper edge of the side wall, such a shape makes a weld seam superfluous. Moreover, the cover member can assume a rounder and smoother bulge in said area as no projecting weld seam is in the way.

Figure 13A:
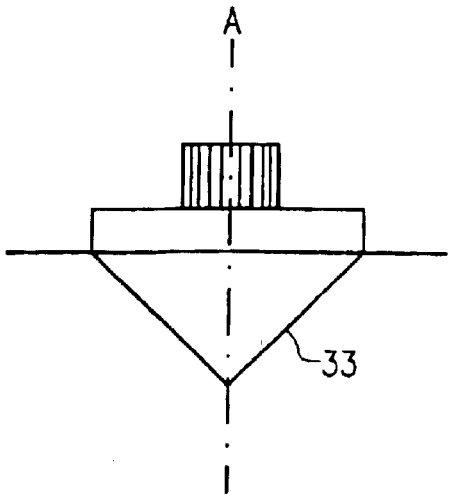
Figure 13B:
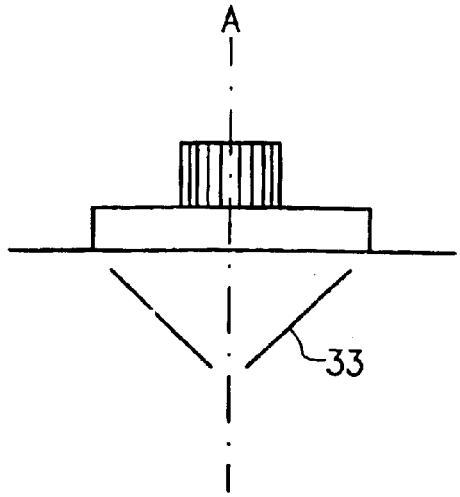
Figure 13C:
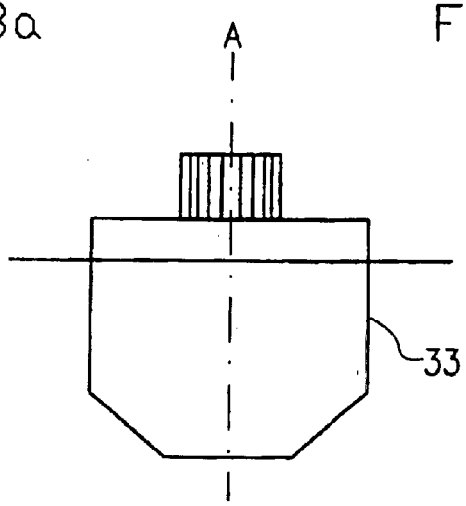
Figure 13D:
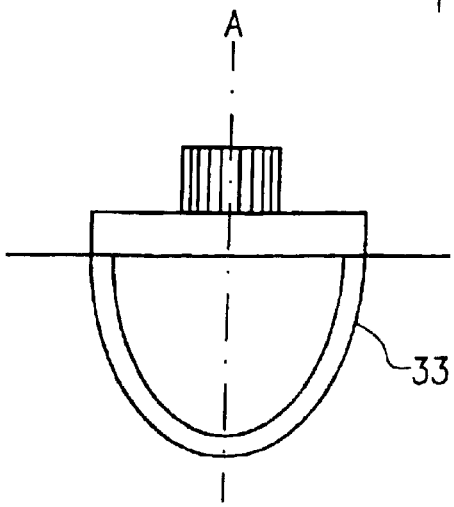
Figure 13E:
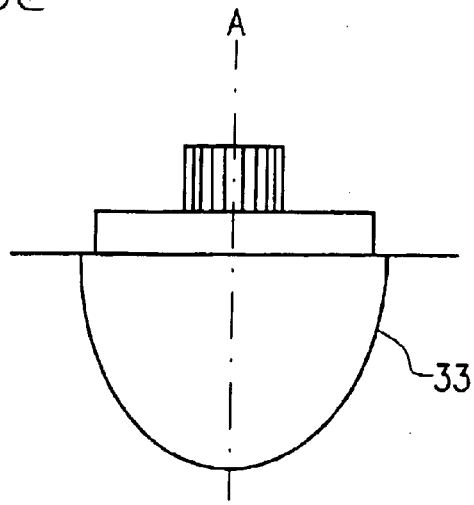

FIGS. 13*a* to *d* show various embodiments of the stabilizing and retaining means. All means have in common that they extend below the closure element 20 from two sides to the central longitudinal axis A of the first side wall 3. FIG. 13*a* shows a triangular shape of the embossment 33. It extends substantially from both side edges of the closure element in triangular fashion downwards. FIG. 13*b* shows two embossments 33 which extend below the closure element 20 towards the central longitudinal axis A. FIG. 13*c* shows an embossment which extends relative to the longitudinal axis A in axial symmetry first in vertical direction, then obliquely and then in horizontal fashion. FIG. 13*d* shows two semioval embossments 33 located one within the other. FIG. 13*e* shows a semioval embossment which extends at the left and right side from the closure element relative to the longitudinal axis A. The embossments need not extend up to the upper edge of the bag or the closure element 20 itself, nor do they have to end exactly with the side edges of the closure element. What is however of importance is that they extend in an area below the closure element 20 approximately in the upper third of the bag. The embossments 34 on the cover member may have the same shapes as the shapes shown in FIG. 13. In this case they extend e.g. from two sides towards the center of the cover member in the direction of fold edge 11*f*.

What is claimed is:

1. A stand up bag of a heat-sealable or weldable plastic, comprising:

two side walls connected to each other at longitudinal edges thereof;

a foldable bottom member positioned between said two side walls and configured to serve as a self-standing bottom arranged at a lower end of said stand up bag between lower transverse edges; and a foldable cover member positioned at an upper end of said stand up bag between said two side walls, and comprising a removal opening between an upper transverse edge of a first side wall of said two side walls and an associated cover member edge, a closure element being inserted into said removal opening;

said stand up bag is provided in said first side wall in an area below said closure element with means for stabilizing and retaining said closure element in a forwardly bent pouring position.

2. The stand up bag according to claim 1, wherein said cover member is provided in an area below said closure element with further means for stabilizing and retaining said closure element in an upright position.

3. The stand up bag according to claim 1, wherein said means for stabilizing and retaining said closure element is formed from at least one embossment.

4. The stand up bag according to claim 3, wherein said at least one embossment extends from two sides towards a central longitudinal axis of said first side wall as a line embossment.

5. The stand up bag according to claim 3, wherein said at least one embossment is a semioval line embossment.

6. The stand up bag according to claim 3, wherein said at least one embossment is a triangular line embossment.

7. The stand up bag according to claim 3, wherein said at least one embossment is directed from an inside to an outside.

8. The stand up bag according to claim 1, wherein said at least one means for stabilizing and retaining said closure element are arranged in a forwardly bent position in an upper third of said first side wall.

9. The stand up bag according to claim 3, wherein said at least one removal opening is formed between a side wall tab formed on a side wall and projecting beyond a transverse edge of said side wall, and a matching cover member tab formed on said cover member, said tabs being interconnected along longitudinal edges.

10. The stand up bag, in particular according to claim 1, wherein said cover member is connected to the respective side wall by seal seams that extend from both longitudinal edges obliquely towards said removal opening of said first side wall or obliquely towards an upper transverse edge of a second side wall of said two side walls, said seal seams being outer seams at a same time.

11. The stand up bag according to claim 1, wherein said two side walls are provided with longitudinal embossments that extend in spaced-apart relationship between said transverse edges and are oriented to an outside.

12. The stand up bag according to claim 1, wherein a length of said first side wall is greater than a length of a second side wall of said two side walls, so that said removal opening of said first side wall comes to rest above the upper transverse edge of said second side wall.

13. The stand up bag according to claim 1, wherein said cover member is made integral with a second side wall of said two side walls.

* * * * *